US007416426B2

(12) United States Patent
Tyler et al.

(10) Patent No.: US 7,416,426 B2
(45) Date of Patent: Aug. 26, 2008

(54) PUSH MATE ASSISTED ELECTRICAL CONNECTOR

(75) Inventors: Adam P. Tyler, Rochester Hills, MI (US); Joel A. Pittenger, Waterford, MI (US); Christian Campfort, Fresnay le Gilmert (FR)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/668,060

(22) Filed: Jan. 29, 2007

(65) Prior Publication Data

US 2007/0178737 A1 Aug. 2, 2007

Related U.S. Application Data

(60) Provisional application No. 60/764,169, filed on Jan. 31, 2006.

(51) Int. Cl.
*H01R 13/62* (2006.01)

(52) U.S. Cl. ..... 439/157

(58) Field of Classification Search ..... 439/157, 439/752, 595, 347, 310
See application file for complete search history.

(56) References Cited

U.S. PATENT DOCUMENTS 4,875,873 A * 10/1989 Ishizuka et al. ..... 439/347
5,575,676 A 11/1996 Tsukakoshi et al. ..... 439/347
5,618,195 A 4/1997 Cappe ..... 439/157
5,660,556 A 8/1997 Badaroux et al. ..... 439/310
5,876,226 A 3/1999 Tsukakoshi et al. ..... 439/157
5,928,013 A 7/1999 Iwahori ..... 439/157
5,964,602 A 10/1999 Aoki et al. ..... 439/157
6,045,375 A 4/2000 Aoki et al. ..... 439/157
6,062,882 A * 5/2000 Hanazaki et al. ..... 439/157
6,077,100 A 6/2000 Sakano ..... 439/347
6,142,826 A 11/2000 Bourillon ..... 439/595
6,149,473 A 11/2000 Lalange et al. ..... 439/752
6,168,445 B1 * 1/2001 Seutschniker et al. ..... 439/157
6,213,795 B1 * 4/2001 Drescher et al. ..... 439/157
6,254,407 B1 * 7/2001 Burns ..... 439/157
6,979,213 B1 * 12/2005 Mauney et al. ..... 439/157

* cited by examiner

*Primary Examiner*—Chandrika Prasad
(74) *Attorney, Agent, or Firm*—Harrington & Smith, PC

(57) ABSTRACT

Disclosed herein is an electrical connector. The electrical connector includes a user contact member, a housing, a plurality of electrical contacts, and a slide. The user contact member has a first extending arm. The first extending arm includes a first cam projection. The housing has a first arm slot. The first arm slot receives the first extending arm. The plurality of electrical contacts are mounted in the housing. The slide is positioned between the first extending arm and the second housing. The slide includes a first cam slot and a second cam slot. The first cam slot receives the first cam projection. The second cam slot is adapted to receive a second cam projection of a mating electrical connector. The electrical connector is configured to receive at least one wire between the housing and the user contact member.

20 Claims, 10 Drawing Sheets

PUSH MATE ASSISTED ELECTRICAL CONNECTOR

CROSS REFERENCE TO RELATED APPLICATION

This application claims priority under 35 U.S.C. §119(e) to U.S. provisional patent application No. 60/764,169 filed Jan. 31, 2006 which is hereby incorporated by reference in its entirety.

BACKGROUND OF THE INVENTION

1. Field of the Invention

The invention relates to an electrical connector and, more particularly, to an electrical connector having a mate assist system for mating to another member.

2. Brief Description of Prior Developments

U.S. Pat. No. 6,254,407 discloses a mechanical assist cam slide device for connecting two electrical connectors to each other.

There is a desire to provide a push-pull mate assisted connector that acts in the connector mating direction and also serves as the wire dress cover.

SUMMARY OF THE INVENTION

In accordance with one aspect of the present invention, an electrical connector is disclosed. The electrical connector includes a user contact member, a housing, a plurality of electrical contacts, and a slide. The user contact member has a first extending arm. The first extending arm includes a first cam projection. The housing has a first arm slot. The first arm slot receives the first extending arm. The plurality of electrical contacts are mounted in the housing. The slide is positioned between the first extending arm and the second housing. The slide includes a first cam slot and a second cam slot. The first cam slot receives the first cam projection. The second cam slot is adapted to receive a second cam projection of a mating electrical connector. The electrical connector is configured to receive at least one wire between the housing and the user contact member.

In accordance with another aspect of the present invention, an electrical connector is disclosed. The electrical connector includes a housing, a plurality of electrical contacts, a user contact member, and a pair of slides. The plurality of electrical contacts are mounted in the housing. The user contact member has at least two extending arms. The extending arms are positioned within the housing. The user contact member forms a wire dress cover. The pair of slides are located between the extending arms. The slides engage with the extending arms. The second housing is disposed between the pair of slides. The slides are adapted to engage with a mating electrical connector. The electrical connector is configured to receive at least one wire between the housing and the user contact member.

In accordance with yet another aspect of the present invention, an electrical connector is disclosed. The electrical connector includes a user contact member, a housing, a plurality of electrical contacts, and a slide. The user contact member has a first extending arm. The housing has an arm slot and a slide slot. The arm slot and the slide slot intersect each other. The arm slot receives the first extending arm. The plurality of electrical contacts are mounted in the housing. The slide is positioned within the slide slot. The slide includes a first cam slot on a first side of the slide and a second cam slot on a second side of the slide. The first cam slot and the second cam slot are reversely angled to one another. The first cam slot is aligned with the arm slot. The second cam slot is adapted to engage with a mating electrical connector. The electrical connector is configured to receive an electrical cable between the housing and the user contact member.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
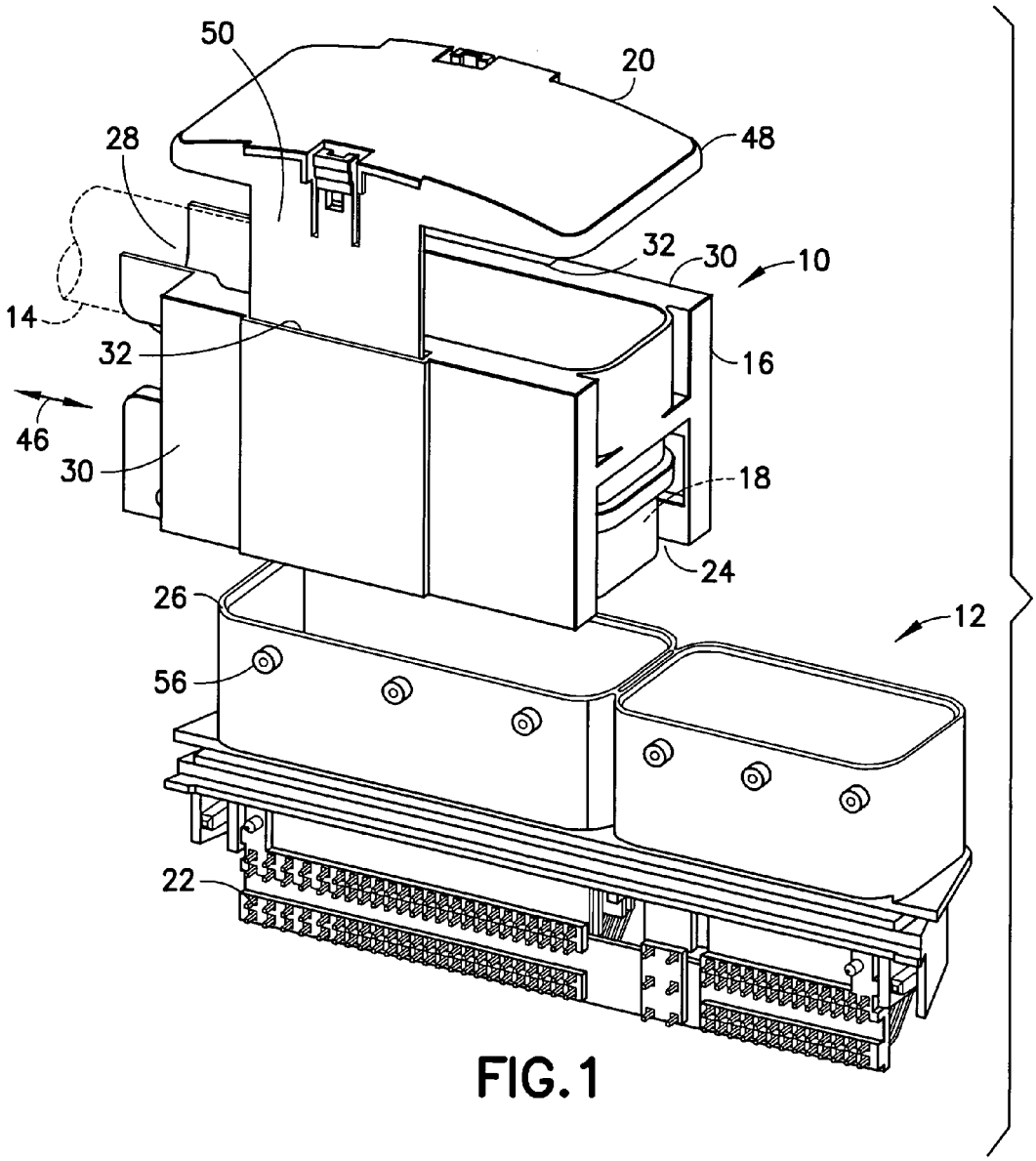
FIG. 1 is a perspective view of an electrical connector comprising features of the invention and a mating electrical connector.

Referring to FIG. 1, there is shown a perspective view of an electrical connector 10 incorporating features of the present invention shown in a position over a mating electrical connector 12. Although the present invention will be described with reference to the exemplary embodiments shown in the drawings, it should be understood that the present invention can be embodied in many alternate forms of embodiments. In addition, any suitable size, shape or type of elements or materials could be used.

The connector 10 is adapted to be connected to an electrical cable 14 (shown in phantom lines in FIG. 1) having a single electrical wire or a plurality of individual electrical wires surrounded by an outer casing. The connector 10 generally comprises a housing 16, electrical contacts 18 and a mate assist system 20. The electrical contacts 18 can comprise any suitable type of electrical contacts adapted to removably connect the wires of the cable 14 to electrical contacts 22 of the mating electrical connector 12. The electrical contacts 18 are fixedly mounted in the housing 16.

The housing 16 generally comprises a bottom side with an aperture 24 for receiving a top portion 26 of the mating electrical connector 12, a cable entrance area 28 at the top side and the end side of the housing, and two side walls 30. The side walls 30 each have two intersecting slots 32, 34. The first slots 32 extend vertically downward into the side walls from the top side of the housing 16. The second slots 34 extend inward from the end 36 of the housing 16; generally orthogonal to the top side.

Figure 2:
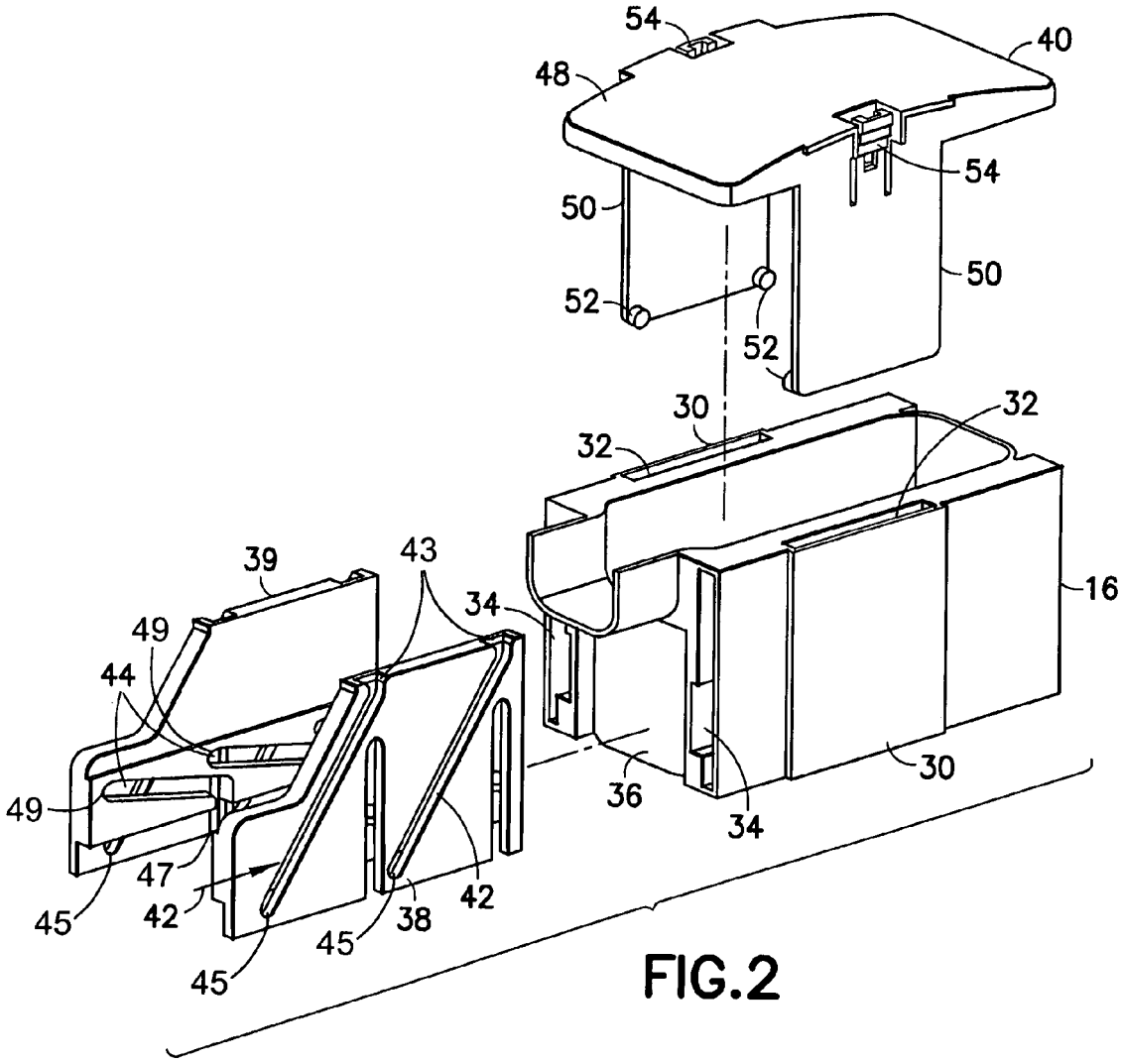
FIG. 2 is an exploded perspective view of some of the components of the electrical connector shown in FIG. 1.
Figure 3:
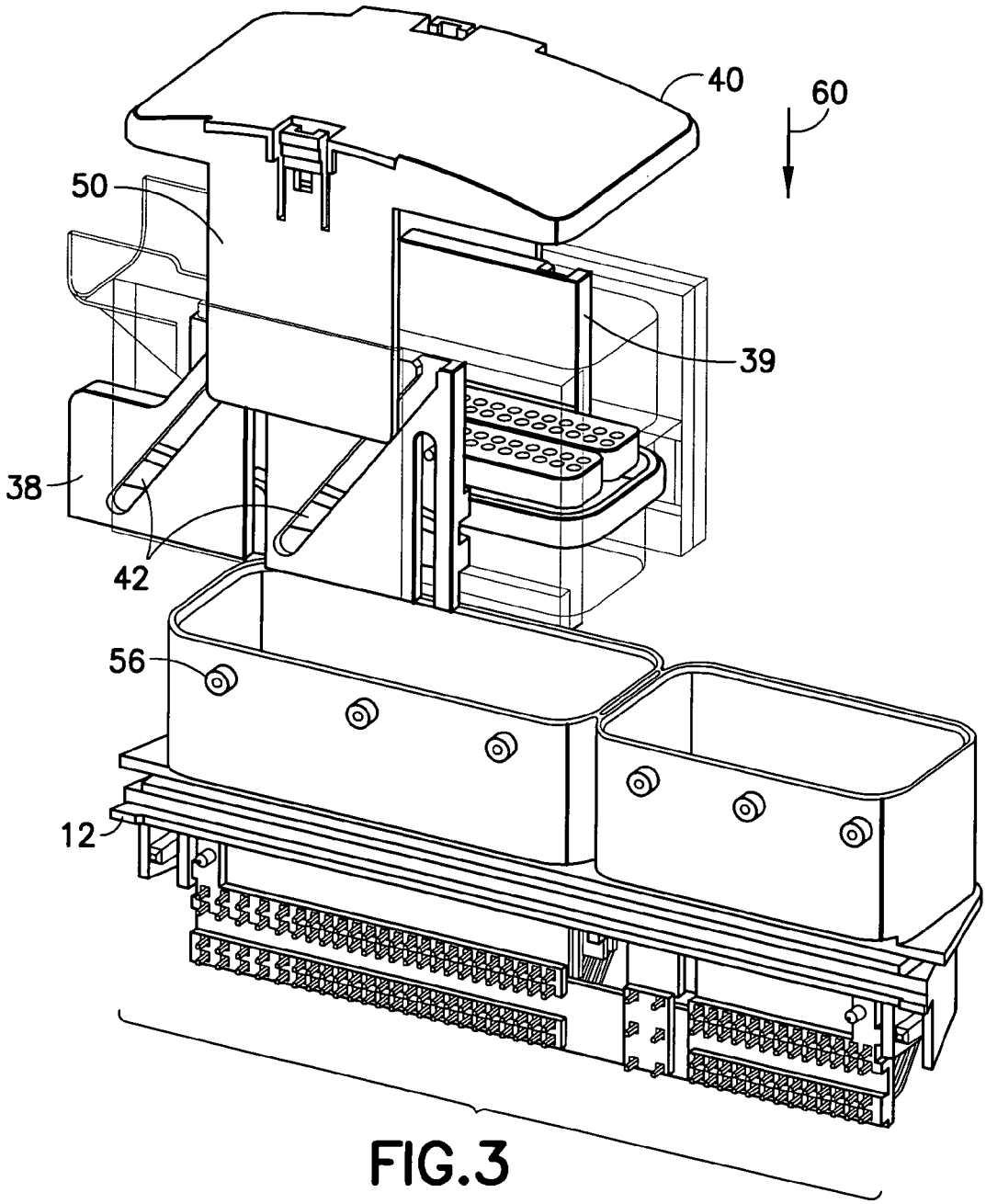
FIG. 3 is a perspective view of the mating electrical connector shown in FIG. 1 and the electrical connector with the housing shown in phantom lines.
Figure 4:
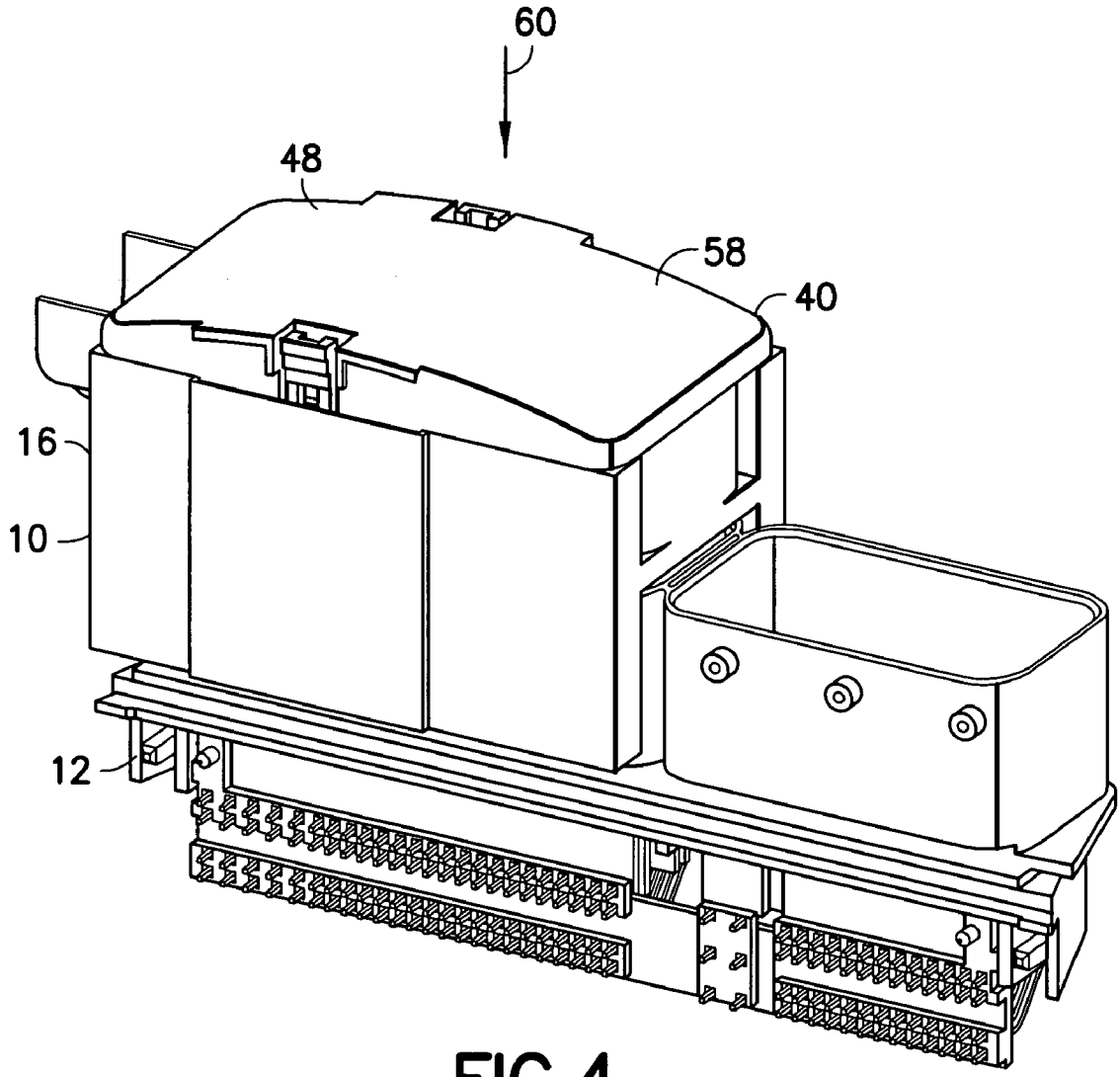
FIG. 4 is a perspective view of the two electrical connectors shown in FIG. 1 in a fully mated position.
Figure 5:
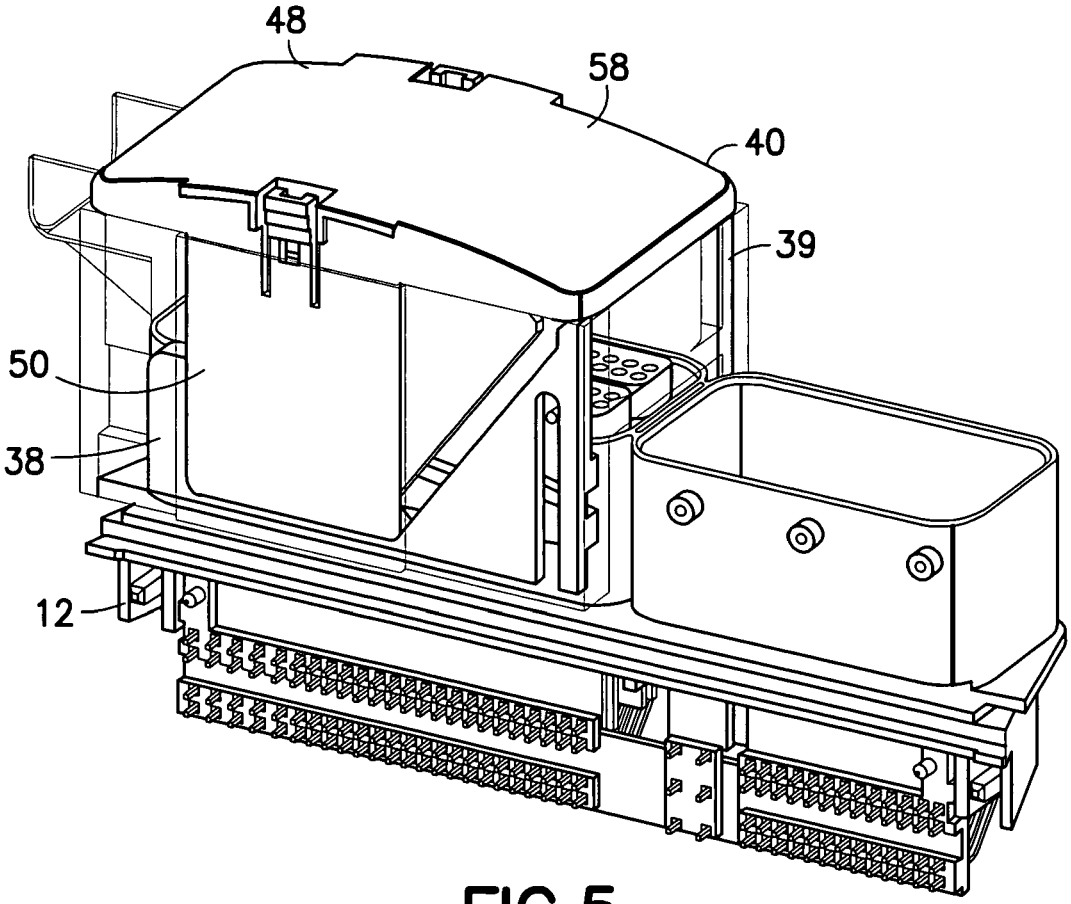
FIG. 5 is a perspective view as in FIG. 4 with the housing of the electrical connector shown in phantom lines.
Figure 6:
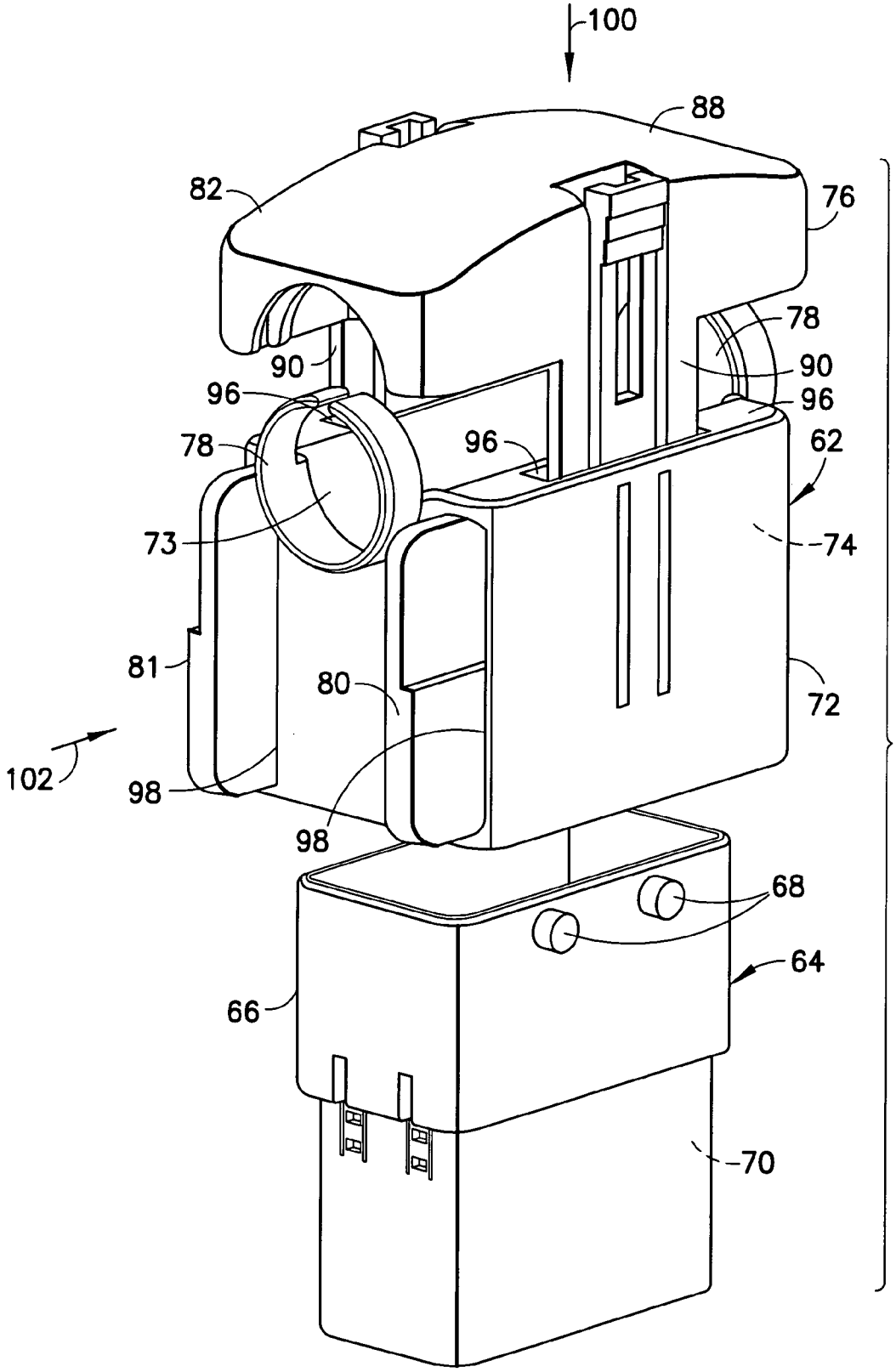
FIG. 6 is a perspective view of an alternate embodiment of an electrical connector comprising features of the invention and a mating electrical connector.

As shown best in FIG. 2, the mate assist system 20 generally comprises two slides 38, 39 and a user contact member 40. The two slides 38, 39 are substantially mirror images of each other. Each slide 38, 39 generally comprises two first cam slots 42 and three second cam slots 44. The first cam slots 42 are located on outward facing sides of the slides 38, 39. The second cam slots 44 are located on inward facing sides of the slides 38, 39. The first cam slots 42 extend downward and rearward from open ends 43 at the top sides of the slides to closed ends 45 proximate the bottom sides of the slides. This provides for the first cam slots 42 to be open in a direction opposite to a direction of connector mating. The second cam slots 44 extend upward and rearward from open ends 47 at the bottom sides of the slides 38, 39 to closed ends 49 at a distance from the bottom sides of the slides 38, 39. This provides for the second cam slots 44 to be open in a direction of connector mating. This also provides for the orientation of the first cam slots 42 (extending downward and rearward) and the second cam slots 44 (extending upward and rearward) to be generally reversely angled to one another. The slides 38, 39 are positioned into the housing 16 through the second slots (or slide slots) 34 and into the junction with the first slots 32. The slides 38, 39 are slidable in the housing 16 between a rearward position as shown in FIGS. 1 and 3 and a forward position as shown in FIGS. 4 and 5 as indicated by arrow 46 in FIG. 1.

The user contact member 40 generally comprises a top section 48 and two downward extending arms 50. The top section 48 forms a top to the interior area of the rest of the housing and, thus, is able to cover the top side of the cable(s) and wires. Hence, the top section forms a wire dress cover for the connector. The arms 50 are substantially mirror images of each other. The arms 50 extend from opposite lateral sides of the top section 48. Each arm 50 comprises a bottom section with two cam projections 52 extending in inward directions. The user contact member 40 is movably mounted to the housing 16 between an up or unactuated position as shown in FIGS. 1 and 3, and a down or actuated position as shown in FIGS. 4 and 5. A top section of each arm 50 has a snap-lock latch section 54 for snap lock connecting the user contact member 40 to the housing 16 in the down position; shown in FIGS. 4 and 5. The arms 50 are slidably located through the top openings of the first slots (or arm slots) 32 in the housing 16. The arms 50 are positioned adjacent the outward facing sides of the slides 38, 39, wherein the arms 50 are between the slides 38, 39 and an outer surface of the side walls 30. This also positions the slides 38, 39 between the arms 50. The first cam slots 42 are aligned with the first slots 32 to allow the cam projections 52 to be received into the top open ends 43 of the first cam slots 42.

As illustrated in FIG. 1, the connector 10 is initially mounted on the top of the mating electrical connector 12. A housing of the mating electrical connector is between the slides 38, 39 wherein cam projections 56 on the housing of the mating electrical connector 12 are received in the second cam slots 44 of the slides 38, 39. With comparison of FIGS. 1 and 3 to FIGS. 4 and 5, when the user pushes on the top side 58 of the top section 48 of the user contact member 40 this causes a caming action which assists in mating the two electrical connectors 10, 12 to each other. More specifically, as the user contact member 40 is pressed down, the cam projections 52 cause the slides 38, 39 to cam inward. In other embodiments it is conceivable, based on cam slot construction and location, that the slides could be driven outward. Possible alternatives include laterally, transversely, or perpendicular to the motion of the user contact member. As the slides 38, 39 are cammed inward, the slides 38, 39 cause the cam projections 56 to cam upward (or the connector 10 to cam downward) because of camming contact of the cam projections 56 in the second slots 44. Thus, the mate assist system uses camming actions to assist in mating the two connectors 10, 12 to each other in direction 60; which is the same direction as the pushing action of the user on the user contact member.

Figure 7:
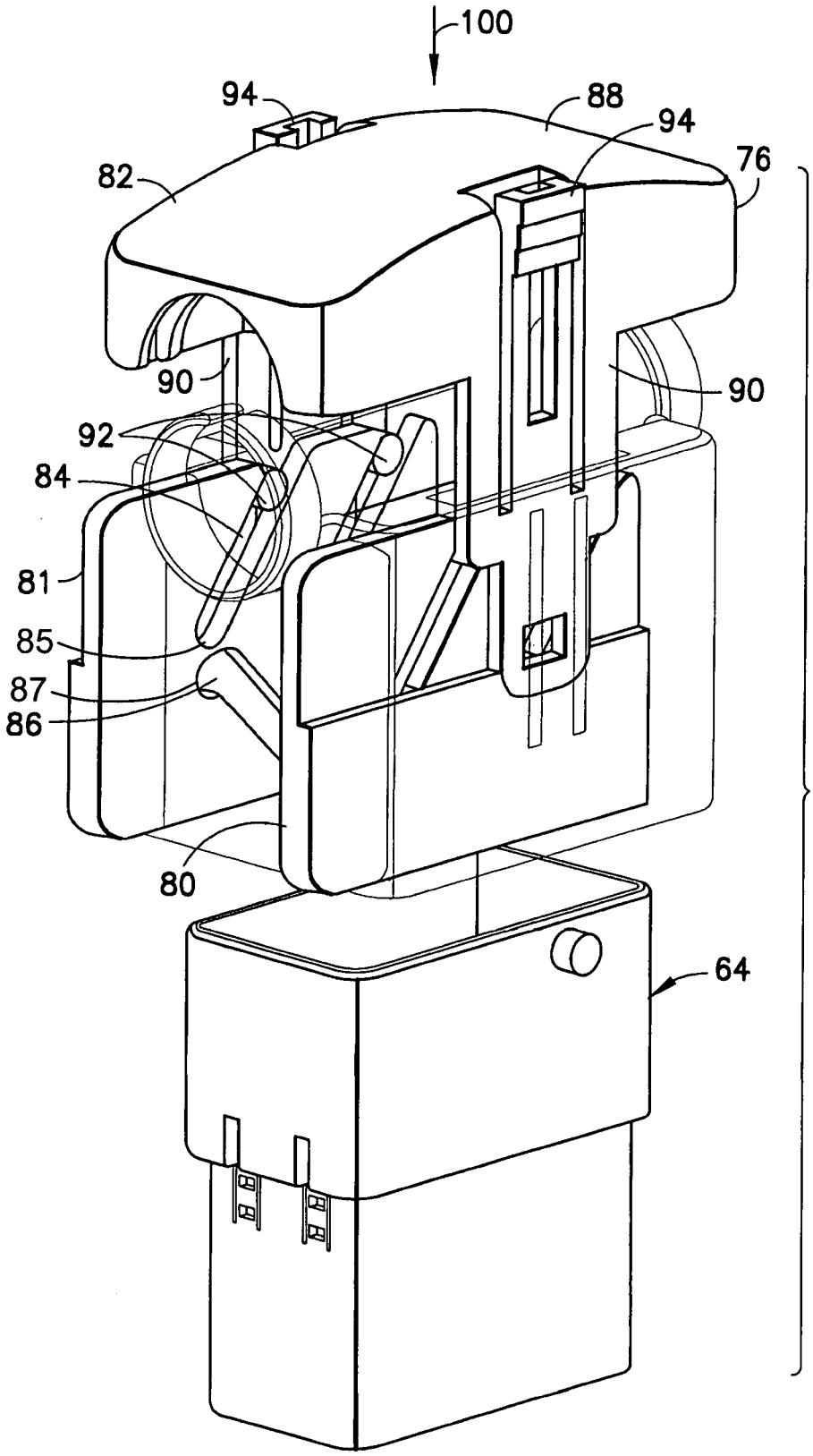
FIG. 7 is a perspective view of the mating electrical connector shown in FIG. 6 and the electrical connector with the housing shown in phantom lines.
Figure 8:
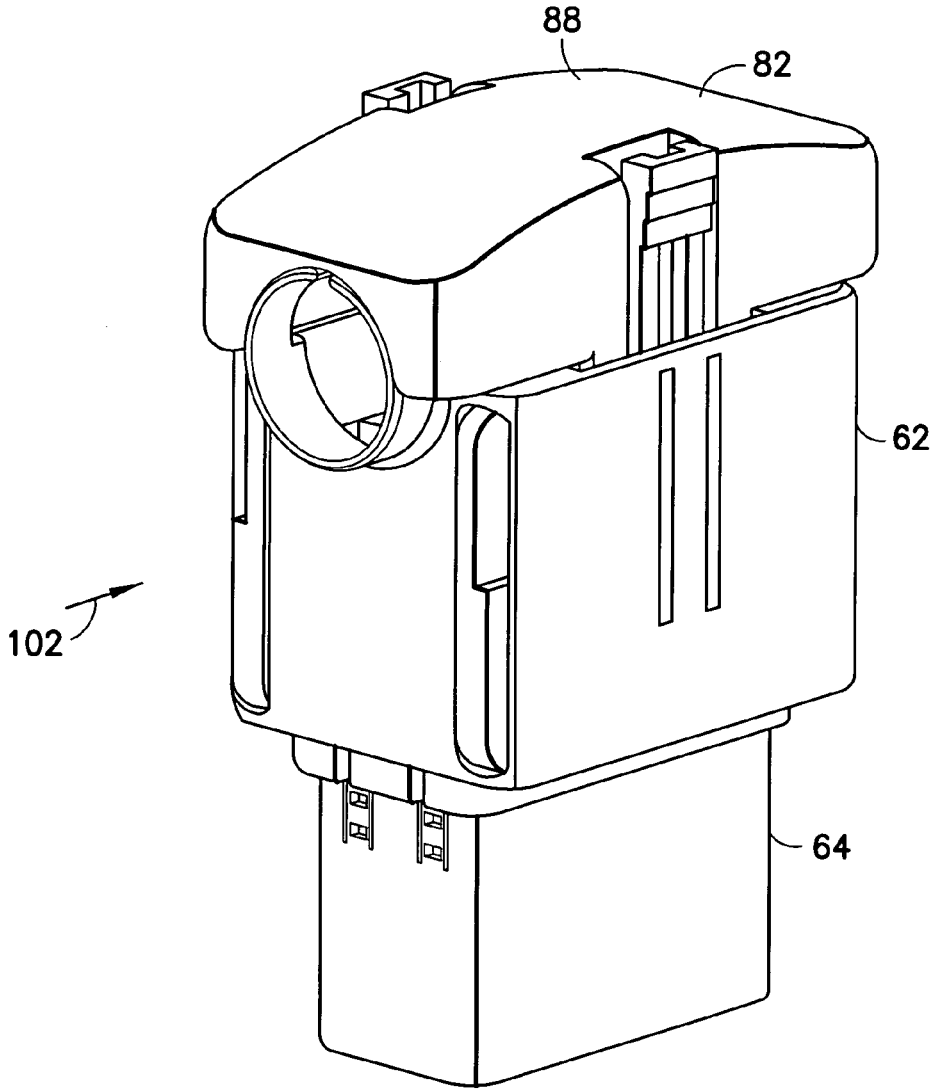
FIG. 8 is a perspective view of the two electrical connectors shown in FIG. 6 in a fully mated position.
Figure 9:
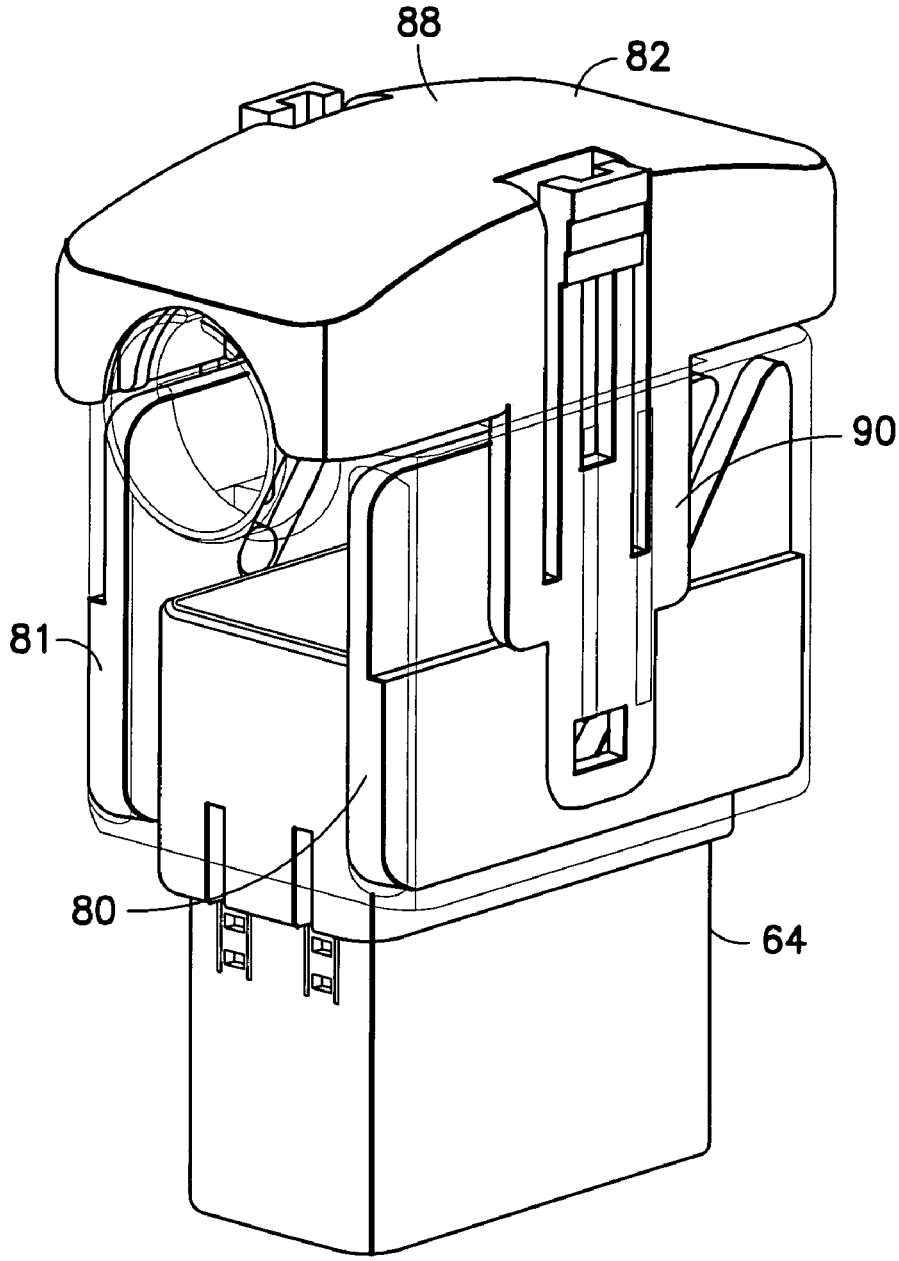
FIG. 9 is a perspective view as in FIG. 8 with the housing of the electrical connector shown in phantom lines.
Figure 10:
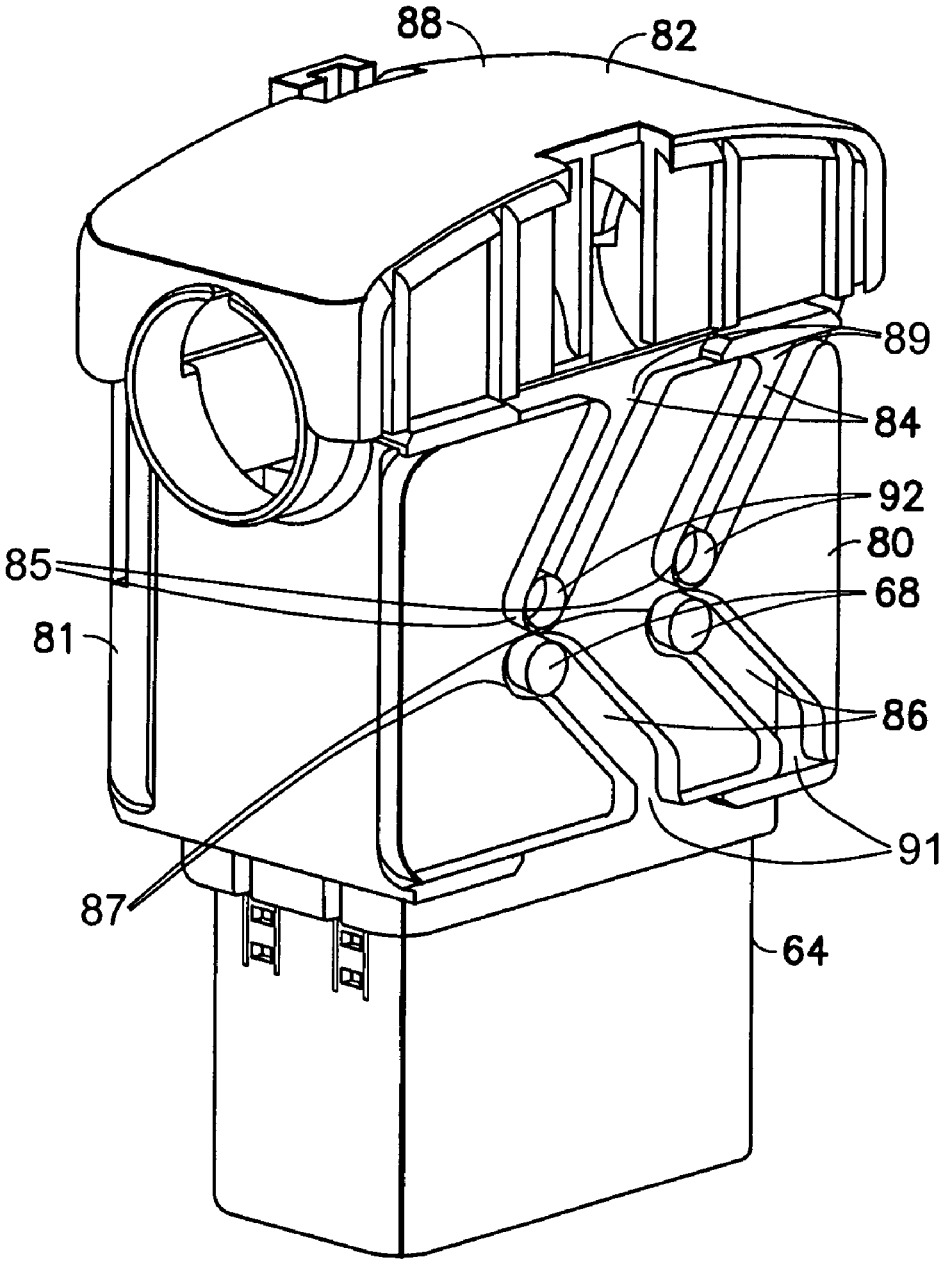
FIG. 10 is a perspective view of the two electrical connectors shown in FIG. 8 with a sectional view of some of the components.

Referring also to FIGS. 6-10, an alternate embodiment of the invention is shown. In this embodiment an electrical connector 62 is provided for connecting to a mating electrical connector 64. The mating electrical connector 64 comprises a housing 66 with cam projections 68 and electrical contacts 70 in the housing. The electrical connector 62 comprises a housing 72, electrical contacts 74 and a mate assist system 76. The housing 72 comprises entrance/exit apertures 78 for cables (not shown) having electrical wires to have access through the housing 72 into an interior area 73 of the housing. The electrical contacts 74 are mounted to the housing 72 in the interior area. The mate assist system 76 generally comprises two slides 80, 81 and a user contact member 82. The slides 80, 81 are substantially mirror images of each other. Each slide has two top cam slots 84 and two bottom cam slots 86. The top cam slots 84 extend through the slides 80, 81 from outward facing sides of the slides to inward facing sides of the slides. The top cam slots 84 are open in a direction opposite to a direction of connector mating. The bottom cam slots 86 extend into the slides from the inward facing sides of the slides. The bottom cam slots 86 are open in a direction of connector mating. The top cam slots 84 and the bottom cam slots 86 may also be generally reversely angled to one another. Additionally, closed ends 85, 87 of the top cam slots 84 and the bottom cam slots 86 may be adjacent one another as illustrated in FIGS. 7 and 10.

The user contact member 82 generally comprises a top section 88 and two arms 90. The top section 88 forms a top to the interior area 73 and, thus, is able to cover the top side of the cable(s) and wires. Thus, the top section forms a wire dress cover for the connector. The arms 90 extend downward from lateral sides of the top section 88. Each arm comprises two inward projecting cam projections 92 and a snap-lock latch 94.

The housing 72 has lateral side walls with first slots 96 extending into the side walls from a top side of the housing 72, and second slots 98 extending into the side walls from an end of the side walls. The slots 96, 98 are joined to each other at a junction. The slides 80, 81 are slidable mounted into the second slots (or slide slots) 98 and into the junctions. The bottom ends of the arms 90 are inserted into the top open ends of the first slots (or arm slots) 96 and into the junctions. When the user contact member 82 is initially inserted into the housing 72, the cam projections 92 are positioned into the top open ends 89 of the first slots 84.

When the connector 62 is initially connected to the mating connector 64, the cam projections 68 are received in the bottom open ends 91 of the second slots 86. Subsequently, the user pushes down (toward the mating electrical connector 64) on the top side of the top section 88 of the user contact section 82 as indicated by arrow 100. Comparing FIGS. 6-7 to FIGS. 8-10, this causes the cam projections 92 to cam the slides 80, 81 inward; deeper into the second slots 98 as indicated by arrow 102. Because the cam projections 68 of the mating connector 64 are located in the second slots 86, the movement of the slides 80, 81 inward cause the cam projections 68 to be moved further into the slides 80, 81. This causes the two connectors 62, 64 to be assisted into mating with each other;

the first connector 62 being cammed and pushed onto the mating connector 64 into their final assembled positions shown in FIGS. 8-10.

In the embodiment shown, the top cam slots 84 form a slide ramp with an angle of about 30° or more and the bottom cam slots form a slide ramp with an angle of about 20° or more. This can provide a total efficiency of about 0.70 (efficiency of 1 for the top slide ramp, and efficiency of 0.7 for the bottom slide ramp). For connectors requiring 100N direct mating force for mating the electrical contacts to each other, for example, the mating force with the efficiency of 0.7 would be 70N. This is only an example. In alternate embodiments any suitable angles could be provided. Preferably, the angled cam slots create a mechanical advantage that can reduce the overall connector mating force experienced at the user contact member.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A mate assisted electrical connector comprising:

a user contact member having a first extending arm, wherein the first extending arm comprises a first cam projection;

a housing having a first arm slot, wherein the first arm slot receives the first extending arm;

a plurality of electrical contacts mounted in the housing; and a slide disposed between the first extending arm and a portion of the housing, wherein the slide comprises a first cam slot and a second cam slot, wherein the first cam slot receives the first cam projection, and wherein the second cam slot is adapted to receive a second cam projection of a mating electrical connector;

wherein the mate assisted electrical connector is configured to receive at least one wire between the housing and the user contact member.

2. The mate assisted electrical connector of claim 1 wherein the first cam slot is open in a direction opposite to a direction of connector mating.

3. The mate assisted electrical connector of claim 1 wherein the second cam slot is open in a direction of connector mating.

4. The mate assisted electrical connector of claim 1 wherein the user contact member further comprises a snap-lock latch section which snap-lock connects to the housing.

5. The mate assisted electrical connector of claim 1 wherein a closed end of the first cam slot is adjacent a closed end of the second cam slot.

6. The mate assisted electrical connector of claim 1 wherein a portion of the first cam slot extends from an outward facing side of the slide to an inward facing side of the slide.

7. The mate assisted electrical connector of claim 1 wherein the housing comprises a cable entrance area.

8. A mate assisted electrical connector comprising:

a housing;

a plurality of electrical contacts mounted in the housing;

a user contact member having at least two extending arms, wherein the extending arms are disposed within the housing, and wherein the user contact member forms a wire dress cover; and a pair of slides disposed between the at least two extending arms, wherein the slides engage with the extending arms; wherein a mating electrical connector receiving area of the housing is between the pair of slides, and wherein the slides are adapted to engage with a mating electrical connector;

wherein the mate assisted electrical connector is configured to receive at least one wire between the housing and the user contact member.

9. The mate assisted electrical connector of claim 8 wherein the user contact member further comprises a top section, wherein the at least two extending arms extend from opposite lateral sides of the top section.

10. The mate assisted electrical connector of claim 8 wherein the at least two extending arms each further comprises a first cam projection.

11. The mate assisted electrical connector of claim 10 wherein the first cam projections are received by first cam slots of the pair of slides.

12. The mate assisted electrical connector of claim 11 wherein the first cam slots extend from outward facing sides of the slides to inward facing sides of the slides.

13. The mate assisted electrical connector of claim 8 wherein the housing further comprises arm slots and slide slots, wherein the arm slots receive the at least two extending arms, wherein the slide slots receive the pair of slides, and wherein the arm slots and the slide slots intersect each other.

14. The mate assisted electrical connector of claim 8 wherein the housing further comprises an electrical wire entrance/exit aperture.

15. An electrical connector comprising:

a user contact member having a first extending arm;

a housing having an arm slot and a slide slot, wherein the arm slot and the slide slot intersect each other, and wherein the arm slot receives the first extending arm;

a plurality of electrical contacts mounted in the housing; and a slide disposed within the slide slot, wherein the slide comprises a first cam slot on a first side of the slide and a second cam slot on a second side of the slide, wherein the first cam slot and the second cam slot are reversely angled to one another, wherein the first cam slot is aligned with the arm slot, and wherein the second cam slot is adapted to engage with a mating electrical connector;

wherein the electrical connector is configured to receive an electrical cable between the housing and the user contact member.

16. The electrical connector of claim 15 wherein the first cam slot receives a first cam projection of the user contact member.

17. The electrical connector of claim 15 wherein the housing further comprises a side wall, wherein the arm slot and the slide slot are within the side wall, and wherein the first extending arm is between the slide and an outer surface of the side wall.

18. The electrical connector of claim 15 wherein the first cam slot is open at a top side of the slide, and wherein the second cam slot is open at a bottom side of the slide.

19. The electrical connector of claim 15 wherein the housing further comprises an aperture adapted to receive a portion of the mating electrical connector.

20. The electrical connector of claim 15 wherein the user contact member further comprises a snap-lock latch section which snap-lock connects to the housing.

* * * * *